US010290938B1

(12) United States Patent
Henneberry et al.

(10) Patent No.: US 10,290,938 B1
(45) Date of Patent: May 14, 2019

(54) LOW PROFILE GIMBAL FOR AIRBORNE RADAR

(71) Applicant: Raytheon Company, Waltham, MA (US)

(72) Inventors: Michael S. Henneberry, Mckinney, TX (US); Heather M. Rahbany, McKinney, TX (US)

(73) Assignee: Raytheon Company, Waltham, MA (US)

( * ) Notice: Subject to any disclaimer, the term of this patent is extended or adjusted under 35 U.S.C. 154(b) by 20 days.

(21) Appl. No.: 15/788,620

(22) Filed: Oct. 19, 2017

(51) Int. Cl.
*H01Q 3/08* (2006.01)

(52) U.S. Cl.
CPC ..... *H01Q 3/08* (2013.01)

(58) Field of Classification Search
CPC ..... H01Q 3/08
USPC ..... 343/765
See application file for complete search history.

(56) References Cited

U.S. PATENT DOCUMENTS

| | | | |
|---|---|---|---|
| 4,499,490 A | 2/1985 | Morgan | |
| 6,355,999 B1 | 3/2002 | Kichiji et al. | |
| 7,141,772 B2 | 11/2006 | Jung et al. | |
| 8,054,520 B2 | 11/2011 | Noh et al. | |
| 9,121,481 B2 | 9/2015 | Sessions | |
| 2015/0330367 A1* | 11/2015 | Homsy | F16C 35/12 416/244 A |

FOREIGN PATENT DOCUMENTS

| | | |
|---|---|---|
| EP | 1246296 A1 | 10/2002 |
| GB | 2266996 A | 11/1993 |
| WO | WO 2013/019161 A1 | 2/2013 |

OTHER PUBLICATIONS

International Search Report for International Application No. PCT/US2018/047002 dated Nov. 15, 2018, 19 pages.

* cited by examiner

*Primary Examiner* — Andrea Lindgren Baltzell

(57) ABSTRACT

A low profile gimbal is disclosed, such as may be used in airborne RADAR applications. The low profile gimbal can include first and second concentric motors disposed in a housing with an antenna or other active element disposed below the housing. The first motor can change the position of the antenna in azimuth. A mechanical linkage between the second motor and the antenna can change the position of the antenna in elevation based on an offset of angular velocity between the first and second motors.

20 Claims, 7 Drawing Sheets

LOW PROFILE GIMBAL FOR AIRBORNE RADAR

BACKGROUND

Gimbals are pivoting supports that allow an object to rotate about an axis. A series of gimbals may be used to support an object in rotation about more than one axis. For example, a two-axis gimbal allows an object to rotate independently about each of the two axes. Gimbals may include a powered means, such as an electric motor, for changing the position of an object about an axis. A two-axis gimbal may include two motors, one each for changing the position, or the direction at which the object is pointed, about each of the axes.

Gimbals are used in a variety of applications from aerospace to professional and consumer electronics. However, there remains a need for improvements in known powered gimbal devices and methods to allow gimbals to be used in even more diverse and advanced applications.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
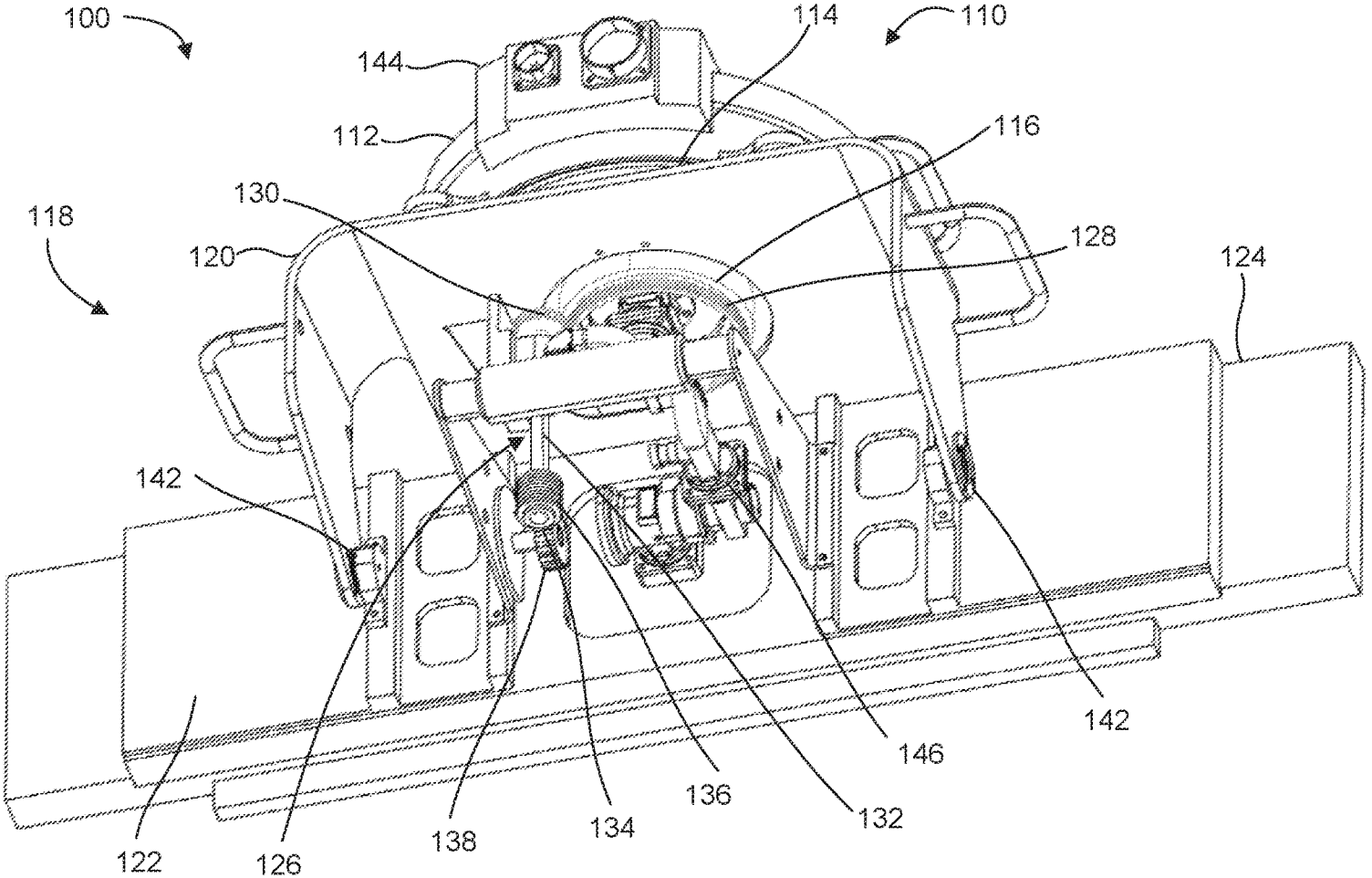
FIG. 1 is a rear perspective view of a low profile gimbal in accordance with an example of the present invention.
Figure 2:
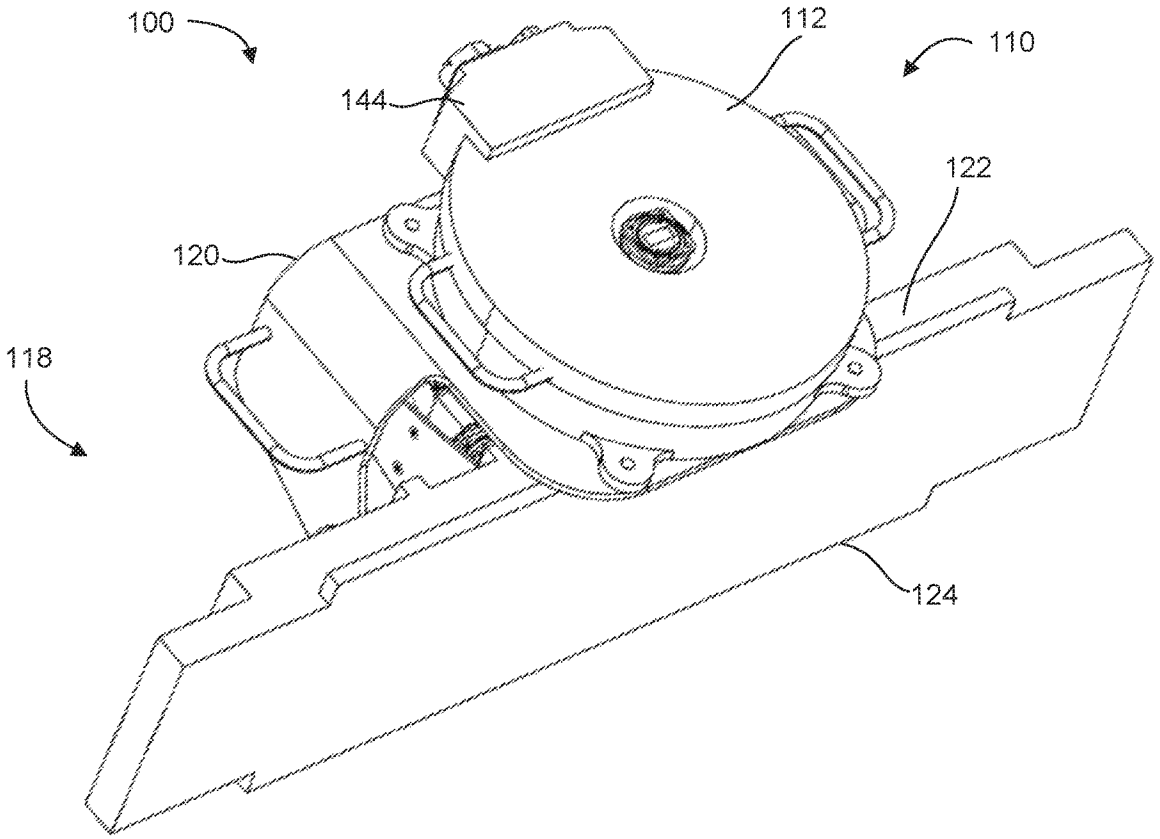
FIG. 2 is a front perspective view of the low profile gimbal of FIG. 1.
Figure 3:
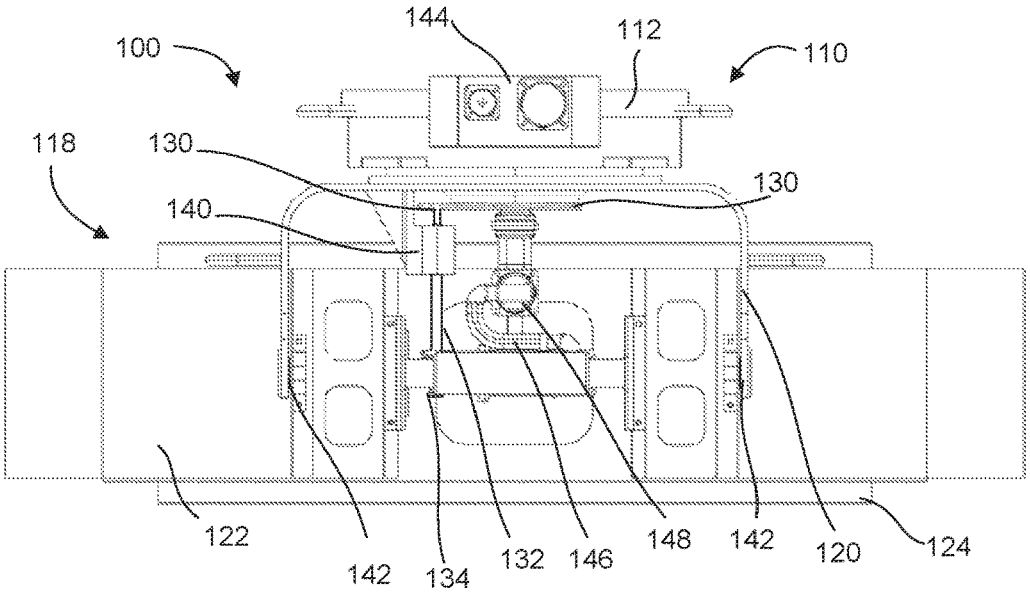
FIG. 3 is a rear view of the low profile gimbal of FIG. 1.
Figure 4:
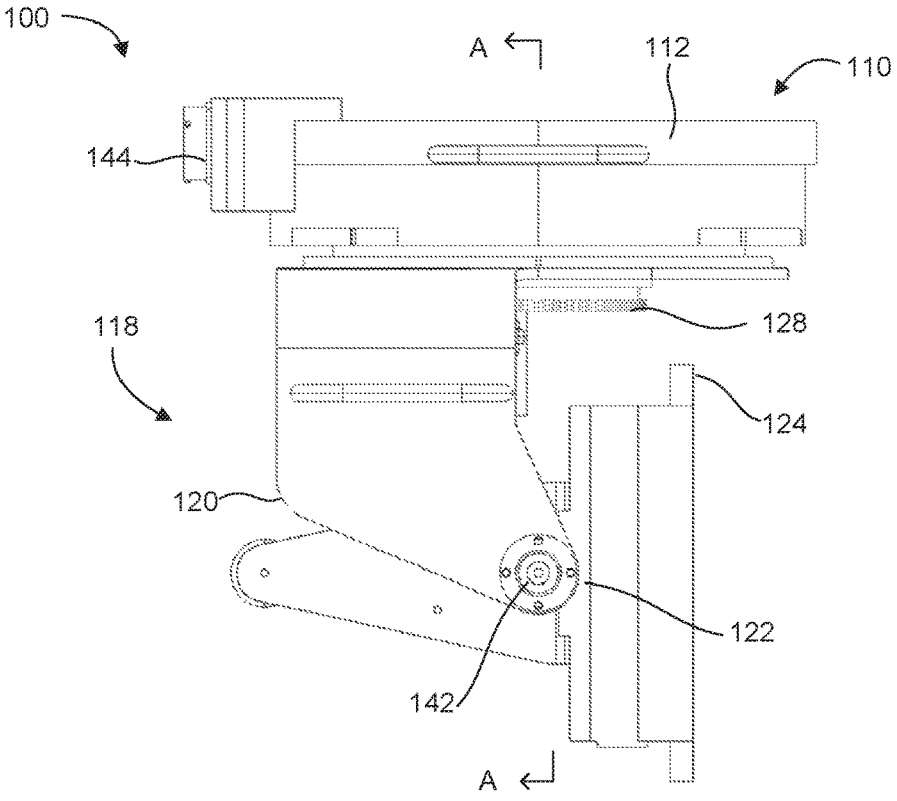
FIG. 4 is a side view of the low profile gimbal of FIG. 1.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness can in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" can be either abutting or connected. Such elements can also be near or close to each other without necessarily contacting each other. The exact degree of proximity can in some cases depend on the specific context.

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

Gimbals may be used to point or steer an object in a particular direction about one or more axes. The position of an object controlled by a two-axis gimbal can be described using the horizontal coordinate system. In the horizontal coordinate system, the two axes of a gimbal may be expressed in terms of elevation and azimuth. Elevation is the angle between the horizon and the position above or below the horizon at which the object is pointed. For example, if an object were pointed upwards at an angle that is 20 degrees above the horizon, the position of the object in elevation could be expressed as positive 20 degrees. Azimuth is the angle around the horizon at which the object is pointed. For example, if an object were pointed at the intermediate direction northeast, or half way between north and east, the object would be pointed 45 degrees east of north, and the position of the object in azimuth could be expressed as 45 degrees.

Gimbals may be used in airbome RADAR applications to steer an RF beam from an antenna, including a flat plate antenna or a reflector antenna, in both azimuth and elevation. The RADAR system, including the gimbal, may be housed in a radome on an aircraft. The radome protects the RADAR system, but often protrudes from the aircraft, causing drag. To decrease drag on applications such as airplanes, efforts have been undertaken to reduce the size of the radome, thereby requiring the size of the gimbal and RADAR structure to also be reduced in order to fit inside the radome.

Current solutions to providing a gimbal and RADAR structure for small radome sizes include cutting a hole in the structure to which the radome is attached, such as the belly of an airplane. Part of the RADAR system, for example the gimbal structure, may be placed in the hole with the remaining portion of the system residing in the smaller radome. For example, the height of a standard two-axis gimbal for RADAR structures may be between 8 and 10 inches, and may be partially or completely placed in a hole in the belly of the airplane to allow room for the RADAR structure in a small radome. However, many aircraft applications do not have sufficient space to allow portions of a RADAR structure to be situated anywhere but within the radome, where a standard two-axis gimbal may not fit.

Other current solutions include reducing the size of the reflector to fit in the small radome, while using a standard two-axis gimbal to mechanically steer the RADAR structure in both azimuth and elevation. Another solution involves decreasing the size of the gimbal to mechanically steer or control only the position in azimuth, while electrically steering the position of the RADAR in elevation using scanning phased arrays. Among other disadvantages, both reducing the size of the reflector and electrically steering the RADAR in elevation reduce system performance due to lower gain produced by the antenna.

Many of the current solutions also include providing a slip ring between the gimbal and the RADAR structure. For example, where the RADAR is electrically steered in elevation, a slip ring is used between the upper gimbal structure and the RADAR structure to deliver power to the antenna and to deliver signals to and from the antenna. Slip rings may also be employed to deliver power to a second axis gimbal motor that may be disposed below the first gimbal motor, where the second motor steers the RADAR in elevation. Slip rings may be a point of failure and may result in required repair or replacement of portions or all of the gimbal and RADAR structure. Current two-axis gimbals for applications including control of RADAR in aircraft are thus characterized by a number of disadvantages.

Accordingly, a low profile gimbal is disclosed herein comprising two low profile, direct drive frameless motors. The motors may be disposed concentric one another, with the first or outer motor driving a scanning portion or support structure in azimuth. A mechanical linkage or gear structure may be disposed between the second motor and the support structure, the gear structure held in place on the support structure, such that it follows the first motor. As the second concentric motor follows or turns at the same radial velocity as the first motor, the mechanical linkage remains static. As the position of the two concentric motors is offset, or in other words a difference in absolute radial positions of the motors is caused by the second motor turning faster or slower than the first motor, the mechanical linkage between the motors is activated. When activated, the mechanical linkage rotates a shaft and a 90 degree gear structure is used to convert the shaft rotation into a change of elevation of an antenna disposed on the support structure. In this way, the second motor is used to command the tilt or elevation of the antenna, such as a RADAR antenna.

The low profile gimbal of the present disclosure may reduce the height of the gimbal from the 8-10 inches of known two-axis gimbals for RADAR applications, to less than 4 inches, thus allowing the antenna to fit within small radome applications. This is accomplished through independent elevation control of the RADAR antenna using concentric torque motors with a mechanical linkage between the second or inside motor and the antenna support structure, the mechanical linkage activated by an offset between the motors. The low profile gimbal also eliminates the need for a second motor disposed below the first gimbal to drive the structure in elevation, thereby eliminating the need for a slip ring. Other advantages of the low profile gimbal of the present disclosure include allowing an airborne RADAR antenna to fit in a greater variety of aircraft that would benefit from small radomes, potentially allowing larger antennas to be used to increase RADAR performance, and increasing reliability while decreasing cost by eliminating slip rings and using fewer motors and moving parts.

The low profile gimbal also provides the advantages of improved control of elevation steering of RF beams in RADAR applications and linear calculation of RADAR pointing accuracy over the entire elevation envelope. The elevation scan rate of RADAR using the low profile gimbal will be faster than other solutions, and feedback of the current elevation angle or position, along with the azimuth angle or position, is available based on processing the position of the concentric motors. The low profile gimbal design also allows an antenna or other object to be turned either clockwise or counterclockwise Though reference will be made to a low profile gimbal used in airborne RADAR applications, the low profile gimbal of the present disclosure may be used to control the position of, point the direction of, or steer, a variety of objects about two axes. For example, the low profile gimbal of the present disclosure may be used in connection with lidar, sonar, lights, lasers, cameras, or any other object that may require positioning about two axes. The concepts described herein may also be equally applicable to a three-axis gimbal. As such, the examples provided herein, and the applications specifically mentioned are not to be limiting in any way, as will be apparent to those skilled in the art.

FIGS. 1-6 show an airborne RADAR system 100 with a low profile gimbal 110 according to an example of the present disclosure. Low profile gimbal 110 can comprise a housing 112 with a first motor 114 disposed in the housing 112 and a second motor 116 disposed in the housing 112. First and second motors 114, 116 can be frameless torque motors, and can be concentric, or disposed concentric one another within housing 112. For example, first motor 114 can have a center opening 115, and second motor 116 can be disposed within center opening 115 of first motor 114. Second motor 116 can also have a center opening 117. A support structure 118 of the RADAR system 100 can be disposed below housing 112. Support structure 118 can include a support frame 120 and an active element 122, and further can be connected to first motor 114, such that when first motor 114 spins, support structure 118 also spins. Support structure 118 can further be described as comprising a mounting location or an object mount for active element 122. Accordingly, active element 122 can be disposed below housing 112 and connected to first motor 114.

Active element 122 can be any object steered or directed by low profile gimbal 110. According to an example of the present disclosure, active element 122 can comprise an antenna 124, such as a reflector plate, or a flat plate with a slotted array. In other examples of the low profile gimbal 110 of the present invention, active element 122 can comprise a sensor, a camera, a light, a laser, or any other object suitable for being directed by low profile gimbal 110.

A mechanical linkage 126 can be disposed between low profile gimbal 110 and support structure 118. For example, mechanical linkage 126 can be disposed between the second motor 116, or more precisely a motor gear 128 disposed on second motor 116, and the active element 122. Mechanical linkage 126 can comprise an upper gear 130, a gear shaft 132, and a 90 degree gear structure 134. Upper gear 130 can be disposed parallel to and in cooperation with motor gear 128 and can be disposed on an upper end of gear shaft 132. Disposed on an opposite or lower end of gear shaft 132, 90 degree gear structure 134 can comprise a worm 136 and a wormgear 138. In other examples, mechanical linkage 126 can comprise any 90 degree gear structure, such as bevel gears or miter gears, suitable for translating the rotation of the gear shaft 132 in azimuth to a rotation in elevation, as described more fully herein.

Mechanical linkage 126 can be attached to support structure 118 such that it follows support structure 118 as it rotates with first motor 114. For example, gear shaft 132 can be disposed in an aperture on a flange 140 attached to support structure 118, such that gear shaft 132 is free to rotate. For example, a bearing can be disposed between gear shaft 132 and flange 140. As first motor 114 and second motor 116 spin or turn at the same radial velocity, or revolutions per minute, mechanical linkage 126 remains inactive. Mechanical linkage 126 follows the first motor 114 while motor gear 128 follows the second motor 116, keeping upper gear 130 in equilibrium. When second motor 116 is offset from first motor 114, or turns faster or slower than first motor 114, upper gear 130 is turned, thereby turning or activating the gear shaft 132.

Activation of the gear shaft 132 can change the position of active element 122 in elevation. 90 degree gear structure 134 can translate the rotation of gear shaft 132 into a rotation in elevation. For example, worm 136, disposed on gear shaft 132, rotates when gear shaft 132 is activated by an offset of second motor 116. Rotation of worm 136 causes wormgear 138 to rotate in elevation. Wormgear 138 can be disposed on support structure 118 and may control the rotation of active element 122, either up or down, in elevation. For example, active element 122 can be attached to support structure 118 at pivoting joints 142 that allow active element 122 to freely pivot up or down in elevation when driven by 90 degree gear structure 134.

In an example, airbome RADAR system 100 is constantly spinning in azimuth. For instance, first motor 114 can spin at a constant 120 revolutions per minute (rpm), such that the support structure 118 and active element 122 also turn at a constant 120 rpm. First motor 114 changes the position of the active element 122 in azimuth, or in other words spins constantly at the desired rpm to constantly move the active element 122 in azimuth. An offset between the first and second motors 114, 116 activates the mechanical linkage 126 to change the position of the active element 122 in elevation. Gear shaft 132 of mechanical linkage 126 is stationary when the angular velocity of the first and second motors 114, 116 is the same. Gear shaft 132 is activated when the angular velocity of the second motor 116 is offset from the angular velocity of the first motor 114.

In an example, both first and second motors 114, 116 can be spinning at a constant angular velocity, say 120 rpm clockwise, thereby spinning active element 122 at 120 rpm in azimuth. Gear shaft 132 will remain stationary with active element 122 stationary in elevation. If the absolute radial position of both first and second motors 114, 116 is the same, active element 122 will be positioned at 0 degrees elevation, or level with the horizon. To direct active element 122 downward in elevation, the angular velocity of second motor 116 can be slowed, causing motor gear 128 to activate upper gear 130, and consequently gear shaft 132, in a clockwise direction. 90 degree gear structure 134 then translates the clockwise turning of gear shaft 132 into downward or negative elevation rotation of active element 122. Once active element 122 is directed to the desired location in elevation, second motor 116 can begin to turn at 120 rpm to match the angular velocity of first motor 114, thereby causing gear shaft 132 to deactivate or remain stationary. With first and second motors 114, 116 spinning at the same angular velocity, but with an offset absolute radial position, active element 122 will remain constantly positioned at the desired location in elevation.

To return the position of active element 122 to 0 degrees elevation, second motor 116 can begin to turn faster or at a greater angular velocity than first motor 114. With the angular velocity of second motor 116 greater than the angular velocity of first motor 114, motor gear 128 will cause upper gear 130 and consequently gear shaft 132, to rotate counter-clockwise. 90 degree gear 134 will translate the counter-clockwise rotation of gear shaft 132 into upward or positive elevation rotation of active element 122. Once the active element reaches the desired position in elevation, second motor 116 can return to 120 rpm to match the angular velocity of first motor 114 in order to deactivate gear shaft 132 and hold active element 122 at a constant or steady position in elevation.

In an example, second motor 116 can completely stopped or reverse direction to more quickly activate a change in the position of active element 122 in elevation. For example, with first and second motor 114, 116 spinning at 120 rpm clockwise, second motor 116 can be temporarily stopped while first motor 114 continues to spin. Temporarily stopping second motor 116 will cause gear shaft 132 to rotate with a greater angular velocity than if gear shaft 132 is activated by a slowing of second motor 116. The greater angular velocity of gear shaft 132 will cause active element 122 to change position in elevation at an increased rate. Similarly, reversing the direction of second motor 116 relative to first motor 114 will cause an even greater increase rate of change in elevation of active element 122.

As will be appreciated by those of ordinary skill in the art, the position of active element 122 in elevation can be changed very rapidly. With active element 122 spinning in azimuth 2 times each second, its position in elevation can be rapidly changed based on the offset velocity of second motor 116. The rate of change of position in elevation will depend on the gear employed between motor gear 128 and upper gear 130, as well as the gearing employed by 90 degree gear 134. For example, a gearing ratio could be chosen that to quickly change the position of active element 122 in elevation in large increments, such as 1 degree increments. Alternatively, a gearing ratio could be chosen to obtain a higher degree of precision with small increments, such as 1/10 or 1/100 of a degree. The more precise gearing ratio will require more time for the offset velocity of the first and second motors 114, 116 to implement a change in elevation of active element 122.

In other examples of the present disclosure, first and second motors 114 and 116 can spin counterclockwise, or can turn at any angular velocity suitable for any application. For example, low profile gimbal 110, by way of first motor 114, can turn active element 122 at a constant 60 rpm in elevation. Alternatively, low profile gimbal can employ an angular velocity of 10, 20, 30, 40, 50, 70, 80, 90, 100, 110, 130 or more rpm, as desired by a particular application.

In yet another example of the present invention, low profile gimbal 110 does not constantly spin, but rather changes the direction of the active element 122 in both azimuth and elevation only as necessary. For example, low profile gimbal can direct a light, laser, or camera to specific coordinates without constantly spinning in azimuth. As will be understood from the present disclosure, low profile gimbal 110 can begin with active element 122, be it a light, a laser, a camera, or another element, directed at 0 degrees azimuth and 0 degrees elevation. First motor 114 and second motor 116 will turn only as necessary to direct active element 122 to the desired position. For example, if the desired position is 180 degrees azimuth, −10 degrees elevation, first motor 114 can make half of a revolution, while second motor 116 will rotate only as necessary to activate gear shaft 132 and change the position in elevation of 90 degree gear 134 to −10 degrees elevation. Depending on the gearing, as described herein, second motor 116 can turn in the same direction as first motor 114, but complete less than half a revolution, or second motor 116 can be required to turn in the opposite direction to achieve the −10 degree elevation positioning of active element 122.

In an example, the control circuitry and structure for the low profile gimbal of the present disclosure can employ any variety of control systems known in the art. A control module 144 can be provided that may comprise control circuitry and programming of control loops to run the low profile gimbal 110. Low profile feedback of the radial position or azimuth position can be received from both the first and second motors 114, 116. For example, inductive encoders, such as pancake resolvers, can be used to track the radial position of the motors. With access to the exact position of each motor, the control module 144 can calculate the necessary location to position the active element 122 as desired. Control module 144 can contain a CPU and a power supply, and can control the movement and position of low profile gimbal 110 based on a number of parameters, including absolute position of first motor 114, absolute position of second motor 116, delta position of first motor 114 to second motor 116, rate and direction of first motor 114, rate and direction of second motor 116, drive on/off of first motor, drive on/off of second motor. In a more complex control module 114 the platform attitude (pitch, roll, yaw, altitude, latitude, longitude, etc.) can be provided from an external sensor and used to stabilize pointing or scanning of active element 122 that removes aircraft motion.

Airbome RADAR 100 can include an RF delivery system 146 that can include a rotary joint 148, as known in the art. Rotary joint 148 allows RF to be sent down to antenna 124 without requiring a slip ring. For example, RF delivery system 146 can reside in and pass through center opening 117 of second motor 116. In other examples consistent with the present disclosure, any other system can reside in center opening 117, and other known components of such systems can replace the components of RF delivery system 146. In some embodiments, a slip ring can be desirable, for example, to deliver power and signal to, and receive output from, a camera disposed on support structure 118 below low profile gimbal 110.

Figure 5:
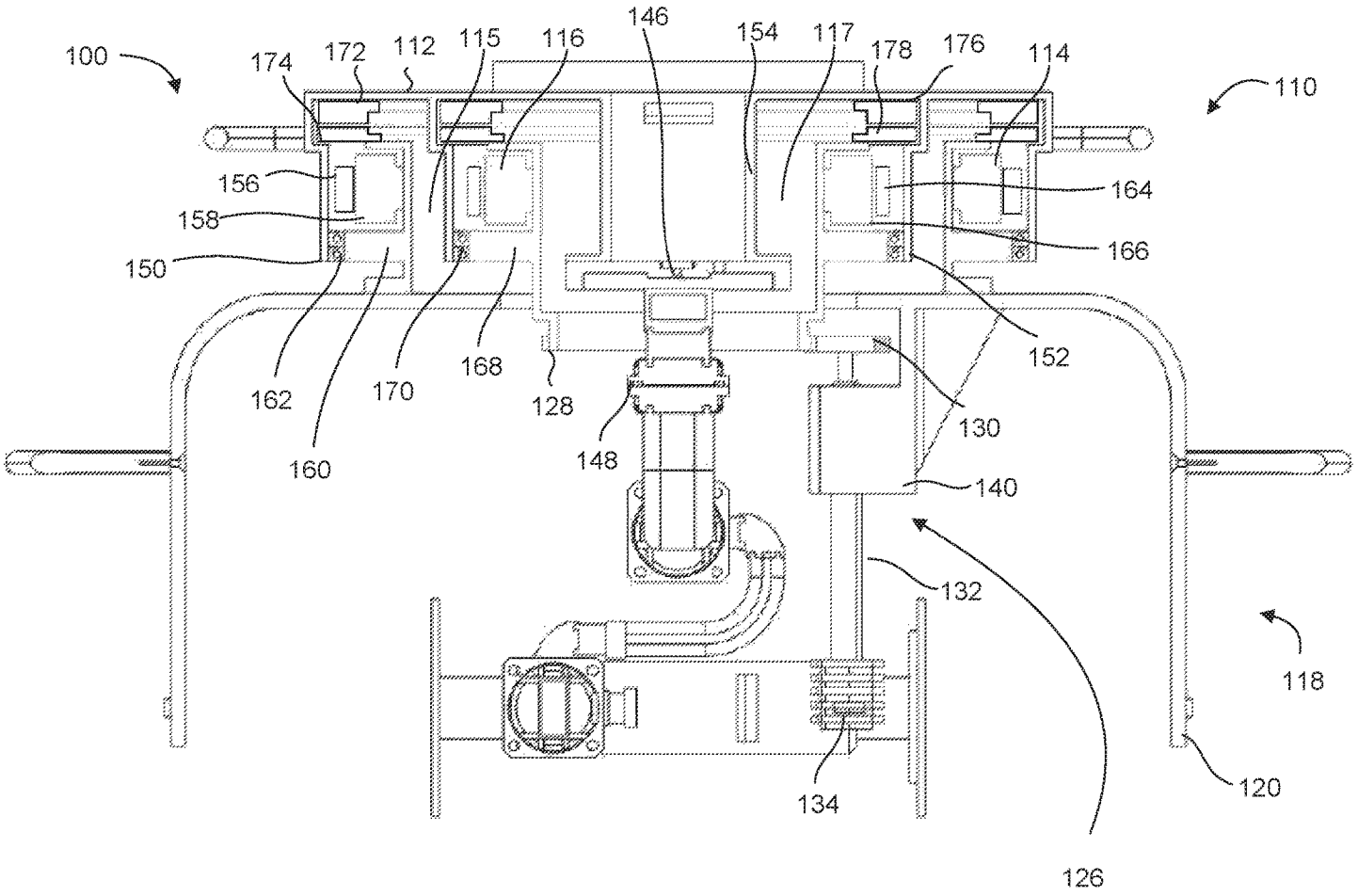
FIG. 5 is a section view of the low profile gimbal of FIG. 1, taken along line A-A of FIG. 4.
Figure 6:
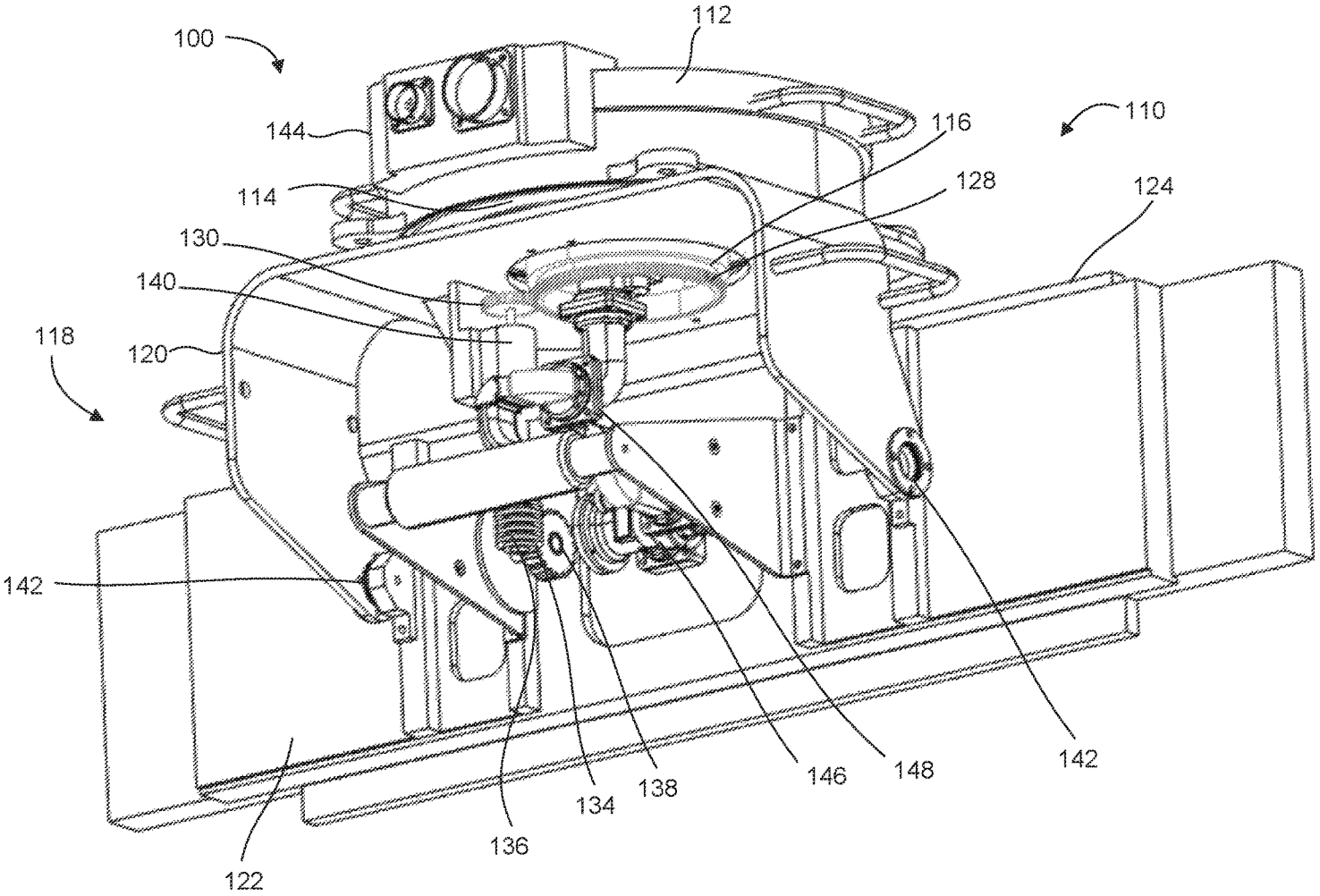
FIG. 6 is a detailed perspective view of the low profile gimbal of FIG. 1.

FIG. 5 shows a cross-section of airborne RADAR 100 including low profile gimbal 110. In an example, housing 112 can include an outer radial wall 150, an intermediate radial wall 152, and an inner radial wall 154. First motor 114 can be disposed between outer radial wall 150 and intermediate radial wall 152, and can comprise a first motor stator 156, a first motor rotor 158 and a first motor tube 160. First motor tube 160 can be held in place against outer radial wall 150 by at least one first motor bearing 162. Second motor 116 can be disposed between intermediate radial wall 152 and inner radial wall 154, and can comprise a second motor stator 164, a second motor rotor 166, and a second motor tube 168. Second motor tube 166 can be held in place against intermediate radial wall 152 by at least one second motor bearing 170.

Also disposed within housing 112, a first motor resolver stator 172 can be attached to the housing 112 between outer radial wall 150 and intermediate radial wall 152, while another first motor resolver rotor 174 can be attached to first motor tube 160 and disposed adjacent first motor resolver stator 172. Similarly, a second motor resolver stator 176 can be attached to the housing between intermediate radial wall 152 and inner radial wall 154, while another second motor resolver rotor 178 can be attached to the second motor tube 168 and disposed adjacent second motor resolver stator 176. First and second motor resolvers 172-178 can comprise pancake resolvers and can be used to track the radial position of the motors 114 and 116, as described herein.

Figure 7:
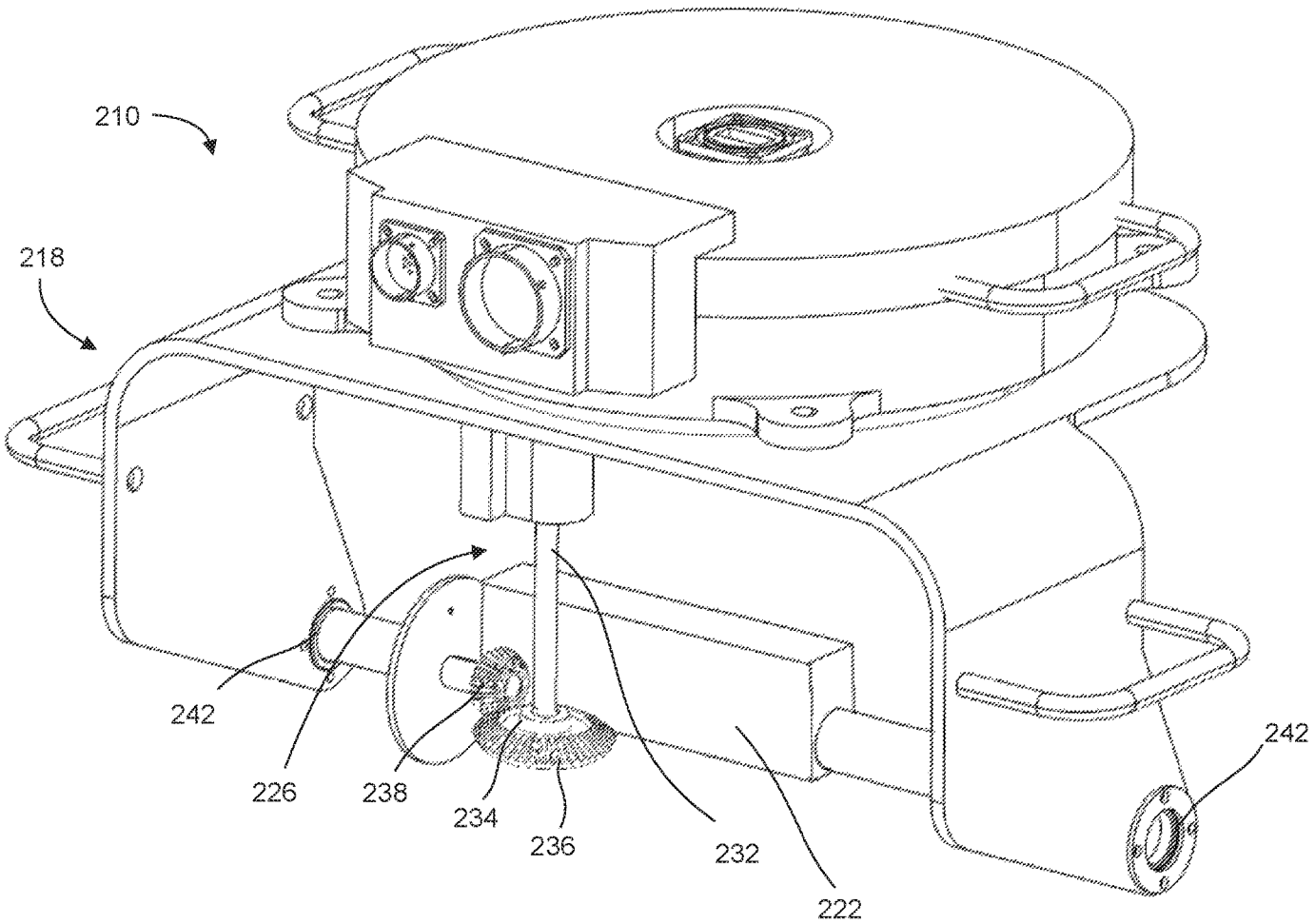
FIG. 7 is a rear perspective view of a low profile gimbal in accordance with another example of the present invention.
Figure 8:
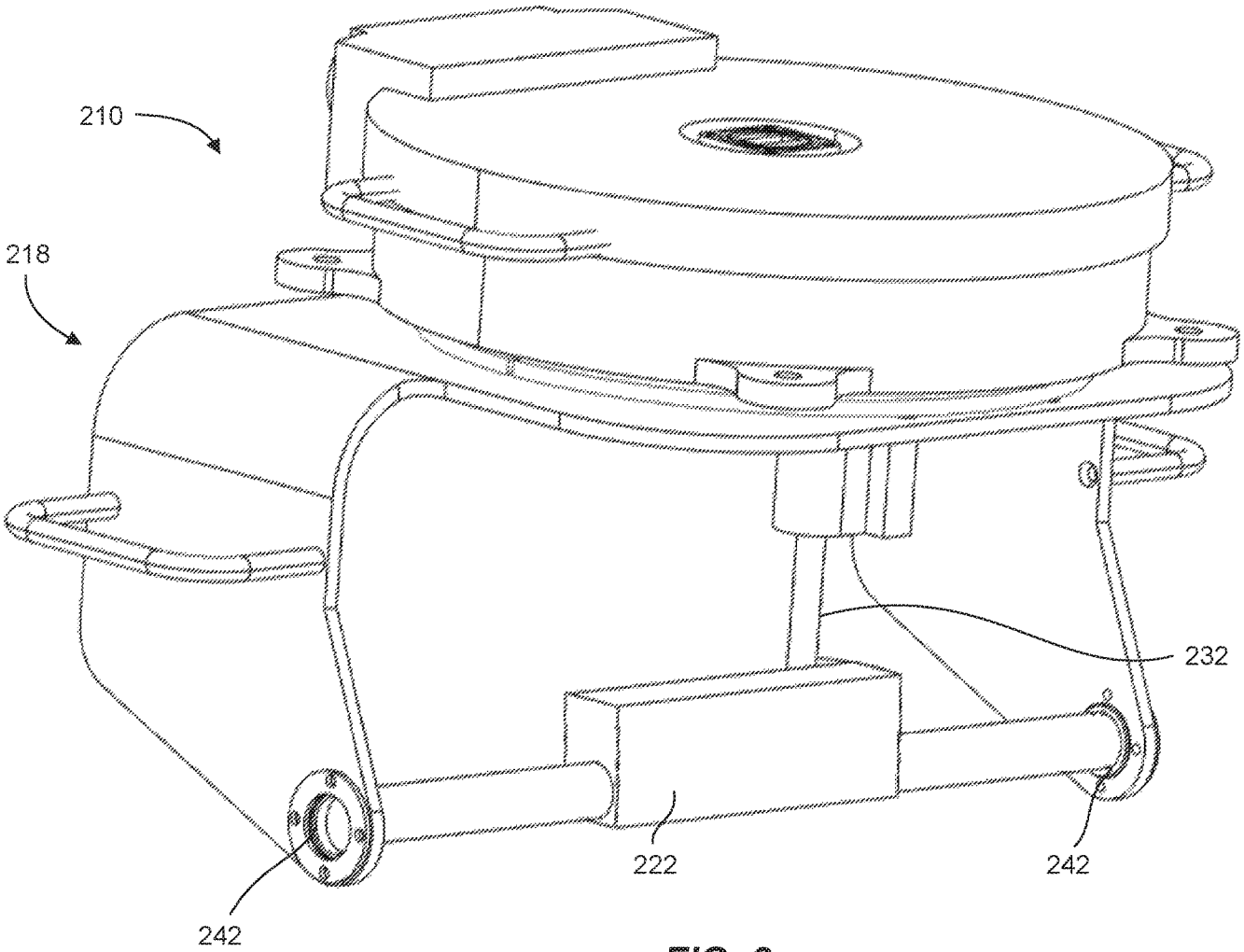
FIG. 8 is a front perspective view of the low profile gimbal of FIG. 7.

FIGS. 7-8 depict a low profile gimbal 210 according to another example of the present invention. As described and depicted more fully herein, low profile gimbal 210 can comprise a first frameless torque motor (not shown) having a center opening and a second frameless torque motor (not shown) disposed concentric with the first motor within the center opening of the first motor. Low profile gimbal 210 can further comprise a support structure 218, which can be coupled to the first motor. Support structure 218 can comprise a mounting location for an object 222 to be directed by low profile gimbal 210. As disclosed herein, object 222 can be an antenna for RADAR, lidar, sonar or other operations, or can be a light, laser, camera or any other object that may be directed by a two-axis gimbal.

Low profile gimbal 210 can also include a mechanical linkage 226 coupled to both the second motor and the support structure 218. Mechanical linkage 226 can include an upper gear (not shown) to cooperate with a motor gear (not shown), as described more fully herein. Mechanical linkage 218 can also include a gear shaft 232 and a 90 degree gear structure 234. 90 degree gear structure 234 can comprise a bevel gear, with a first bevel gear 236 parallel to gear shaft 232 and a second bevel gear 238 disposed at a 90 degree angle relative to first bevel gear 236. Second bevel gear 238 can drive the positioning of the object 222 in azimuth or change the position of support structure 218 in elevation. Object 222 can be disposed on support structure 218 with pivoting joints 242, and second bevel gear 238 may be attached or connected to object 222, such that any rotation of second bevel gear 238 causes object 222 to rotate in elevation.

The first motor of low profile gimbal 210 changes the position of support structure 218 in azimuth while the second motor and mechanical linkage 226 change the position of the support structure 218 in elevation. As described more fully herein, the position of the support structure 218 in elevation is constant as the first and second motors turn at the same rate and the position of the support structure 218 in elevation is changed as the second motor turns faster or slower than the first motor. In an example, an offset between the position of the first and second motors of low profile gimbal 210 causes the gear shaft 232 to turn and changes the position of the support structure 218 in elevation.

The present disclosure further sets forth a method for changing the position of an object in two axes, which can include obtaining first and second concentric torque motors and an object mount capable of rotating in azimuth and elevation, the object mount attached to the first motor and supporting the object. The method can further include obtaining a mechanical linkage between the second motor and the object mount. With the motors and mechanical linkage in place, the method can then include rotating the first and second motors at the same rate in the same direction to change the position of the object in azimuth without changing the position of the object in elevation. The method can further include rotating the second motor faster or slower than the first motor to activate the mechanical linkage and change the position of the object in elevation.

In an example, the object can be a RADAR antenna. The first and second motors can rotate at over 60 revolutions per minute. In yet another example, the object can be a camera, or any other object suitable for being directed in two axes by a gimbal, as discussed herein. The mechanical linkage of the method can be a 90 degree gear structure, such as a worm and wormgear, or bevel gears. In an embodiment, the method can further include the step of obtaining a low profile housing for the first and second concentric torque motors.

It is noted that no specific order is required in this method, though generally in one embodiment, these method steps can be carried out sequentially.

It is to be understood that the examples of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular examples only and is not intended to be limiting.

As used herein, a plurality of items, structural elements, compositional elements, and/or materials can be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention can be referred to herein along with alternatives for the various components thereof. It is understood that such embodiments, examples, and alternatives are not to be construed as de facto equivalents of one another, but are to be considered as separate and autonomous representations of the present invention.

Although the disclosure may not expressly disclose that some examples or features described herein may be combined with other examples or features described herein, this disclosure should be read to describe any such combinations that would be practicable by one of ordinary skill in the art. The user of "or" in this disclosure should be understood to mean non-exclusive or, i.e., "and/or," unless otherwise indicated herein.

Furthermore, the described features, structures, or characteristics can be combined in any suitable manner in one or more examples. In the description, numerous specific details are provided, such as examples of lengths, widths, shapes, etc., to provide a thorough understanding of examples of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A low profile gimbal comprising:
a first motor disposed in a housing;
a second motor disposed in the housing;
an active element disposed below the housing and connected to the first motor; and
a mechanical linkage disposed between the second motor and the active element,
wherein the first motor changes the position of the active element in azimuth and an offset between the first and second motors activates the mechanical linkage to change the position of the active element in elevation.

2. The low profile gimbal of claim 1, wherein the first and second motors are frameless torque motors.

3. The low profile gimbal of claim 2, wherein the first and second motors are concentric.

4. The low profile gimbal of claim 2, wherein the second motor is disposed within a center opening of the first motor.

5. The low profile gimbal of claim 1, wherein the housing comprises an outer radial wall and an intermediate radial wall.

6. The low profile gimbal of claim 5, wherein the first motor is held in place against the outer radial wall and the second motor is held in place against the intermediate radial wall.

7. The low profile gimbal of claim 1, wherein the mechanical linkage comprises a 90 degree gear structure.

8. The low profile gimbal of claim 1, further comprising a motor gear disposed on the second motor, wherein the mechanical linkage comprises a gear shaft with an upper gear parallel to the motor gear and a lower gear comprising a 90 degree gear structure controlling the elevation of the active element.

9. The low profile gimbal of claim 8, wherein the gear shaft is stationary when the angular velocity of the first and second motors is the same, and the gear shaft is activated when the angular velocity of the second motor is offset from the angular velocity of the first motor, wherein activation of the gear shaft changes the position of the active element in elevation.

10. A low profile gimbal comprising:
a first frameless torque motor having a center opening,
a second frameless torque motor disposed concentric with the first motor and within the center opening of the first motor;
a support structure coupled to the first motor; and
a mechanical linkage coupled to the second motor and the support structure,
wherein the first motor changes the position of the support structure in azimuth and the second motor and mechanical linkage change the position of the support structure in elevation.

11. The low profile gimbal of claim 10, wherein the position of the support structure in elevation is constant as the first and second motors turn at the same rate and the position of the support structure in elevation is changed as the second motor turns faster or slower than the first motor.

12. The low profile gimbal of claim 10, further comprising a motor gear disposed on the second motor, wherein the mechanical linkage comprises:
a gear shaft having an upper gear disposed on a first end of the gear shaft and a lower gear disposed on a second end of the gear shaft, the upper gear cooperating with and parallel to the motor gear; and
a 90 degree gear cooperating with the lower gear and coupled to the support structure to change the position of the support structure in elevation.

13. The low profile gimbal of claim 12, wherein the lower gear of the gear shaft is a worm and the 90 degree gear is a worm gear.

14. The low profile gimbal of claim 12, wherein the lower gear of the gear shaft and the 90 degree gear are bevel gears.

15. The low profile gimbal of claim 12, wherein an offset between the position of the first and second motors causes the gear shaft to turn and changes the position of the support structure in elevation.

16. A method for changing the position of an object in two axes, the method comprising:
obtaining first and second concentric torque motors;
obtaining an object mount supporting the object, and capable of rotating in azimuth and elevation, the object mount attached to the first motor;
obtaining a mechanical linkage between the second motor and the object mount;

rotating the first and second motors at the same rate in the same direction to change the position of the object in azimuth without changing the position of the object in elevation; and rotating the second motor faster or slower than the first motor to activate the mechanical linkage and change the position of the object in elevation.

17. The method of claim 16, wherein the second motor is disposed within a center opening of the first motor.

18. The method of claim 16, wherein the mechanical linkage is a 90 degree gear structure.

19. The method of claim 16, further comprising obtaining a low profile housing for the first and second concentric torque motors.

20. The method of claim 19, wherein the low profile housing comprises an outer radial wall and an intermediate radial wall, and wherein the first motor is held in place against the outer radial wall and the second motor is held in place against the intermediate radial wall.

* * * * *